US005598677A

United States Patent [19]

Rehm, III

[11] Patent Number: 5,598,677

[45] Date of Patent: Feb. 4, 1997

[54] INSULATED COVERING FOR BUILDING SHEATHING

[76] Inventor: Frederick G. Rehm, III, 2524 Waolani Ave., Honolulu, Hi. 96817

[21] Appl. No.: 574,933

[22] Filed: Dec. 19, 1995

[51] Int. Cl.[6] ..... E04B 1/74; E04D 1/28

[52] U.S. Cl. ..... 52/407.1; 52/309.9; 52/530; 52/535; 52/553

[58] Field of Search ..... 52/309.4, 309.8, 52/309.9, 309.14, 404.4, 404.1, 405.1, 405.2, 406.1, 406.3, 407.1, 518, 529, 530, 535, 553, 554, 555, 796.1

[56] References Cited

U.S. PATENT DOCUMENTS

| | | | |
|---|---|---|---|
| 705,207 | 7/1902 | Charlebois | 52/530 |
| 3,248,835 | 5/1966 | Westlind . | |
| 3,312,031 | 4/1967 | Berg | 52/530 |
| 3,473,274 | 10/1969 | Godes . | |
| 3,816,610 | 6/1974 | Lusby . | |
| 4,279,106 | 7/1981 | Gleason et al. | 52/309.8 X |
| 4,343,126 | 8/1982 | Hoofe, III . | |
| 4,453,349 | 6/1984 | Ryan | 52/404.4 X |
| 4,598,522 | 7/1986 | Hoofe, III | 52/555 |
| 4,803,818 | 2/1989 | Funaki | 52/530 X |
| 5,194,323 | 3/1993 | Savoy . | |
| 5,373,674 | 12/1994 | Winter, IV . | |
| 5,442,888 | 8/1995 | Ilnyckyj . | |
| 5,465,543 | 11/1995 | Seifert | 52/309.8 |

FOREIGN PATENT DOCUMENTS

| | | | |
|---|---|---|---|
| 1084230 | 8/1980 | Canada | 52/535 |

*Primary Examiner*—Carl D. Friedman
*Assistant Examiner*—Kevin D. Wilkens
*Attorney, Agent, or Firm*—Seth M. Reiss, Esq.

[57] ABSTRACT

An insulated covering for building sheathing comprising foam insulation shaped to occupy the area between raised construction panels and the building sheathing and sized to leave narrow air-gaps, horizontally and vertically, between the outside surfaces of the foam insert and inside surfaces of the raised aspects of the construction panel. The panels are secured to the building in a manner that allows the foam insert to float, freely, within the raised panel. The inserts provide the panels with enhanced structural durability and improved insulating qualities. Allowing the insert to float freely within the raised panels prevents annoying noises and panel deformation caused when tight fitting foam insulation expands during rapid temperature changes and warm weather. A foam insert shaped to accomodate simulated shake roof aluminum roofing panels is illustrated.

12 Claims, 5 Drawing Sheets

INSULATED COVERING FOR BUILDING SHEATHING

BACKGROUND

1. Field of Invention

The present invention relates to interlocking construction panels of the type used for roofing and siding. More particularly, this invention describes an insulated covering for building sheathing having a free floating insulating insert that occupies the void between the raised panels and roof deck or exterior wall sheathing and provides structural support and insulation.

2. Description of the Prior Art

A variety of raised construction panels for roofing and siding are well known in the prior art, made of materials including thermoplastic, fiberglass and metal. Such panels are often constructed with interlocking edges, and sometimes with decorative patterns simulating traditional roofing materials such as tile or shake. One such panel is described by Hoofe, U.S. Pat. No. 4,434,126. A limitation of these panels are that, being raised and relatively light weight, they often lack the structural integrity to support a person or withstand severe weather. Another drawback of raised roof panels is their limited insulation qualities.

A primary object of the present invention is to provide a raised construction panel having improved the structural strength and thermal insulating characteristics.

Construction panels which include a layer of insulating material, or to which is adhered an insulation backing, are also well known and commercially available. The insulating material is commonly foam, often impregnated with termicide. The foam layers and backing provide raised construction panels with additional strength and thermal insulation capacity. However the insulation and panel materials expand and contract at different rates, causing the materials to bind one against the other and emit annoying noises. This phenomena is particularly notable whenever the sun passes in and out of clouds in the case of raised metal roof panels that include foam backing. Moreover, foam insulation that is tightly fitted between raised construction panels and the building structure press upward against the panels and may cause the raised metal panels to deform and buckle.

A further purpose of the present invention is to provide a foam insert for raised construction panels that effectively increases the structural performance and insulating characteristics of the panel without binding or pressing outward against the panel or building deck during warm weather conditions or rapid temperature changes.

It is yet another object of the present invention to provide a foam insert for raised construction panels that resists infiltration by insects including termites.

SUMMARY, OBJECTS AND ADVANTAGES OF THE INVENTION

These and other objects are accomplished in the present invention, an insulated covering for building sheathing comprising a foam insert that occupies the void between raised construction panels and the building exterior leaving a narrow air gap between the top surface of the foam insert and the bottom surface of the construction panel, as well as laterally, between adjoining insert sections and between the outside insert edge and inside panel edge. The foam is shaped to follow in a precise manner the corresponding contours of all raised aspects of the construction panel, and is cut away to allow non-raised aspects of the construction panel to sit directly on, or be secured to, to the building surface or structural sheathing.

Similar to the layered and insulation backing found in prior art construction panels, the free floating insulating inserts of the present invention provide raised panels with improved structural strength and integrity to withstand loads without damage from foot traffic, hailstones and light equipment. The insert of the present invention also provides an additional degree of thermal insulation from heat gain in warm months and heat loss during the winter months.

Unlike insulation components of prior art construction panels, the insulating inserts of the present invention do not bind or otherwise press against the construction panel. Binding is precluded by virtue of the insert being free floating within the raised aspects of the panel and the inclusion of a narrow air-gaps, vertically between the top surface of the foam insert and the bottom surface of the raised panel and horizontally between adjoining foam inserts and between insert edges and non-raised aspects of the panel. The foam insert of the present invention will not rub, press outward against, or deform the construction panel during periods of hot weather, and will not cause annoying noises as the sun passes in and out of clouds. Only when a load, such as a person, is placed on top of the panel will the insert touch the panel while providing necessary structural support.

The insert is molded from fire resistent foam material or a fire retardant can be added. When the insert is treated with an insecticide, as for example TIM-BOR, protection is obtained against termites and other wood boring insects which otherwise tend to occupy areas between the raised construction panels and the roof deck or exterior wall.

Further objects and advantages of the present invention will become apparent from consideration of the ensuing description and drawings.

BRIEF DESCRIPTION OF THE DRAWINGS

The details of typical, but not limiting, embodiments of the present invention will be described in connection with the accompanying drawings.

DETAILED DESCRIPTION OF THE PREFERRED EMBODIMENT

Figure 1:
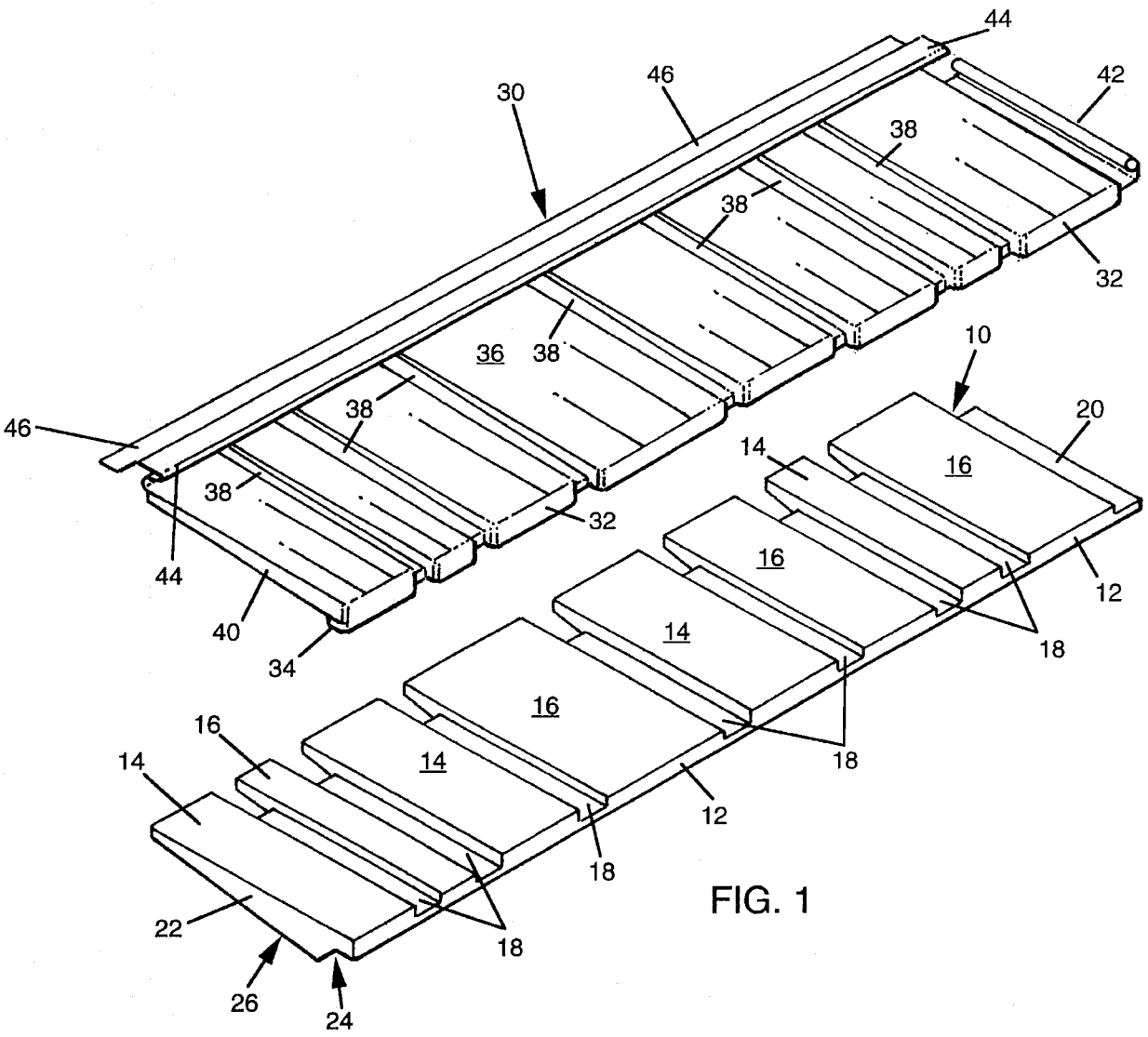
FIG. 1 is a an exploded perspective view showing the foam insert of the present invention and a raised metal roofing panel.

A preferred embodiment of the insulated covering of the present invention, having a free floating insert 10 and a corresponding raised construction panel 30, is illustrated in FIG. 1. Raised interlocking panel 30 depicted in FIG. 1 is typical of the simulated shake roof aluminum panels commercially available. Foam insert 10 is molded to fit inside interlocking panel 30 leaving narrow vertical and horizontal air-gaps between insert 10 and panel 30 when panel 30 is secured to a roof deck, building exterior or structural sheathing.

Insert 10 has a front edge profile 12, a top surface comprised of a plurality of alternating high profile surfaces 14 and low profile surfaces 16 each separated from the adjoining surface by a gap channel 18, a join channel 20 forming the right edge of insert 10, a left edge profile 22, and an overlap channel 24 running the length of the forward edge of a bottom surface 26.

Interlocking panel 30 has a front profile 32, a plurality of overlap joining tabs 34 which extend backwards from the bottom of front profile 32, an upper surface 36 comprised of alternating high and low profile surfaces separated from one another by a plurality of panel gutters 38, a female interlock 40 along its left edge, a male interlock 42 along its right edge, a top interlock 44 extending outward from rear edge of top surface 36, and a nailing edge 46 extending rearward from top interlock 44.

Foam insert 10 is shaped to fit neatly inside interlocking panel 30 without binding panel 30. Consequently, front edge profile 12 has substantially the same dimensions, being only slightly shorter and narrower, than front profile 32 of panel 30. Similarly, surfaces 14 and 16 have the same relative dimensions, being only smaller, compared with the high and low profile surfaces found on upper surface 36 of panel 30. Panel gutters 38 taper downward towards the back of panel 30. Gap channels 18 similarly taper downward and are cutaway prior to reaching the rear edge of surfaces 14 and 16.

End join channel 20 corresponds to and is shaped to accommodate male interlock 42. Similarly overlap mating channel 24 corresponds to and is shaped to accommodate overlap joining tabs 34 and top interlock 44.

Figure 2:
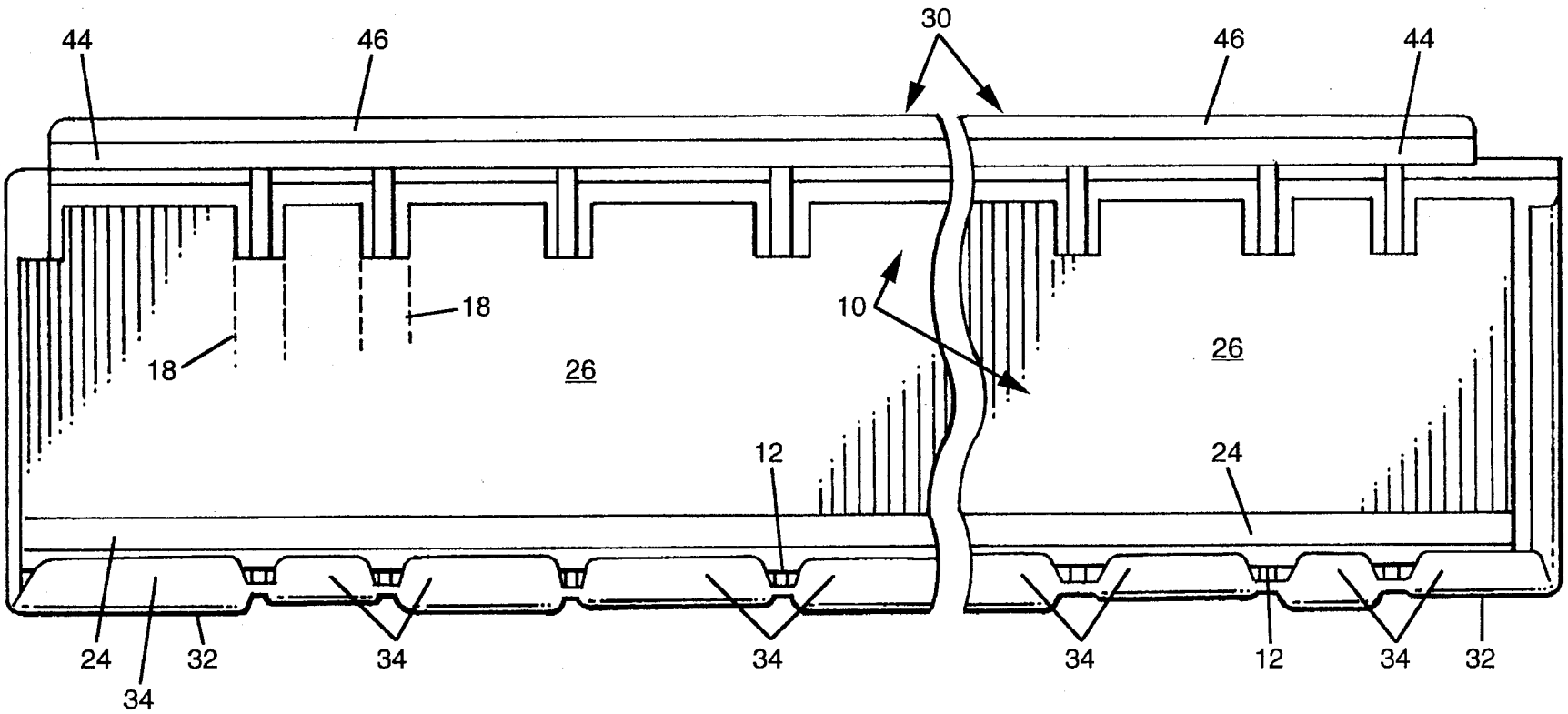
FIG. 2 is a bottom view showing the foam insert nested within the roofing panel.

FIG. 2 is a bottom view of foam insert 10 nested inside interlocking panel 30. Bottom surface 26 is sized to fit inside the raised portions of panel 30 and occupy the space therein. Bottom surface 26 of insert 10 demonstrates cutaway sections formed by the early termination of the rear aspect of gap channels 18. Overlap joining tabs 34 extend over and around front edge profile 12 and overlap channel 24. Top interlock 44 and nailing edge 46 are affixed along the rear edge of interlocking panel 30.

Figure 3:
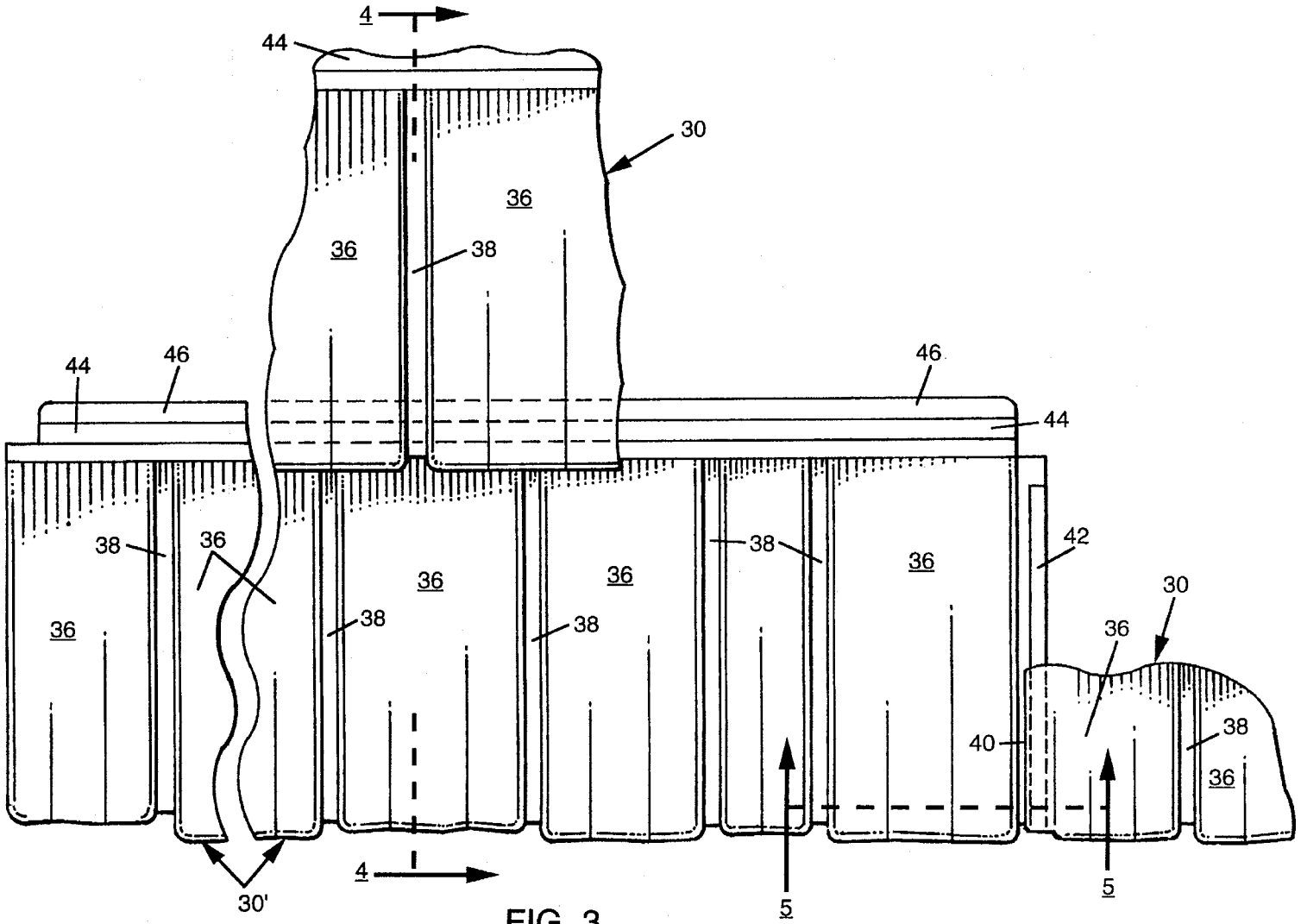
FIG. 3 is a top view of the roofing panels, engaged laterally and top to bottom.

Panels 30 are seen from the top in FIG. 3, engaged laterally and top to bottom. Top surface 36 of panel 30 is comprised of high and low profile surfaces separated by panel gutters 38. Extending along the back side of panel 30 is top interlock 44 and nailing edge 46. Male interlock 42 lying along the right edge of panel 30 is engaged in female interlock 40 extending along the left edge of the adjacent panel 30.

Figure 4:
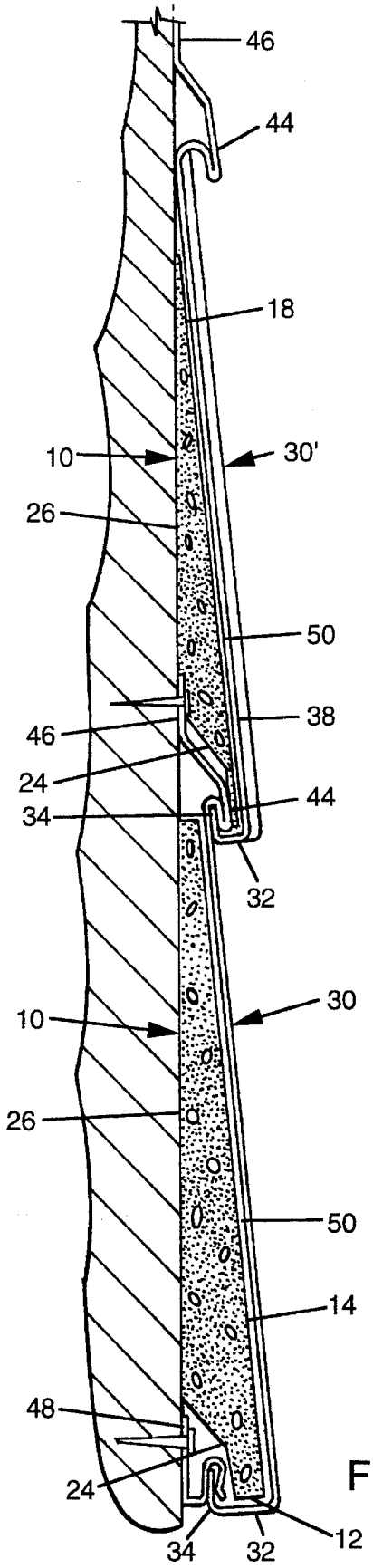
FIG. 4 is an enlarged sectional view showing the foam insert within the roofing panel demonstrating narrow vertical and horizontal air-gaps between the foam insert and raised portions of the roofing panel.

The enlarged sectional view of FIG. 4 shows the manner of securing and interlocking panels 30 occupied by foam inserts 10. Foam inserts 10 are each one nested within panels 30. A starting nailing strip 48 is nailed into the downstream edge of the roof deck or exterior wall structural sheathing. A first (downstream) panel 30' is secured to the deck or wall by inserting overlap joining tabs 34 that extend from front profile 32 (the downstream edge) of panel 30' into starting nailing strip 48 and, thereafter, nailing through nailing edge 46 that extends from top interlock 44 along the upstream edge of panel 30'. The adjacent (upstream) panel 30 is then joined to the downstream panel 30' by inserting overlap joining tabs 34 of panel 30 into top interlock 44 that extends from the upstream edge of panel 30'. Upstream panel 30 is then secured by nailing through nailing edge 46 (not shown for this panel), a further upstream panel is inserted, and nailed, and so on.

FIG. 4 is taken along line 4—4 of FIG. 3 demonstrating a high profile section for downstream panel 30' and a gutter panel section for upstream panel 30. High profile surface 14 of insert 10 lies in close proximity to the bottom surface of panel 30', while gap channel 18 of insert 10 lies in close proximity to the bottom surface of panel gutter 38 of panel 30. As can be seen, foam insert 10 occupies almost all the void created between the raised portions of panel 30 and the roof sheathing. A narrow vertical air-gap 50 between the top surface 14 of insert 10 and the bottom surface of panel 30' (as well as between the top of gap channel 18 and the bottom surface of panel gutter 38 of panel 30) prevents insert 10 from binding or pressing outward, vertically, against panel 30.

A narrow horizontal air-gap 52 between front edge profile 12 of insert 10 and the inside surface of front profile 32 of panel 30 prevents insert 10 from binding or pressing outward, horizontally, against panel 30. The further vertical and horizontal gaps provided by overlap channel 24 prevents insert 10 from binding on top interlock 44, nailing edge 46 or starting nailing strip 48.

Panel 30 is nailed directly into the structural sheathing, and is not secured either to or through insert 10. Thus, foam insert 10 is permitted to float freely within the void of raised panel 30 and will not bind or deform panel 30 during periods of warm weather.

Figure 5:
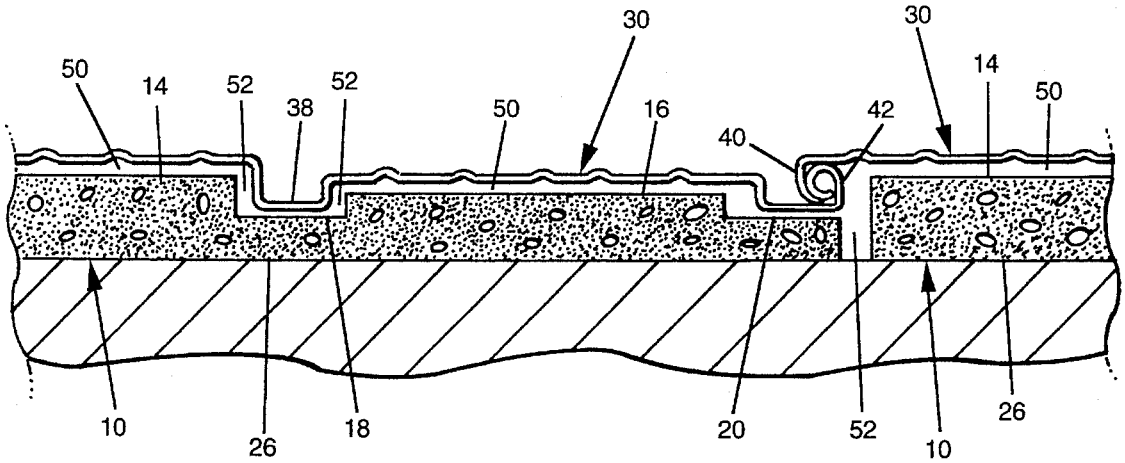
FIG. 5 is an enlarged sectional view showing the foam insert within the roofing panel demonstrating a narrow horizontal air-gap between inserts laterally.

FIG. 5, taken along line 5—5 of the panel 30 shown in FIG. 3, illustrates panels 30 interlocking laterally. High and low surfaces 14 and 16 of insert 10 are separated by gap channels 18 which underlie panel gutters 38 of interlock panels 30. Join channel 20 of insert 10 occupies the space below the raised lateral interlock formed by female interlock 40 and male interlock 42 forming the left and right edges, respectively, of panel 30. Between the top surfaces of insert 10 and the bottom surfaces of panel 30, is vertical air-gap 50. Between laterally adjacent inserts 10 is horizontal air-gap 52.

The width of air-gaps 50 and 52 will vary depending on the size of panel 30, and the material from which panel 30 is constructed. In the case of large aluminum construction panels, the width of vertical air-gap 50 will normally range between 1 and 6 millimeters while the width of horizontal air-gap 52 will normally range between 6 and 20 millimeters.

If a load is placed on interlocking panel 30, the panel is depressed slightly and vertical air-gap 50 in FIGS. 4 and 5 disappears while foam insert 10 provides structural support to panel 30. When the load is removed, panel 30 resumes its original form and vertical air-gap 50 is re-established.

During periods of warm weather, horizontal air-gap 52 in FIG. 5 diminishes with expansion of inserts 10 and, in winter months, the width of horizontal air-gap 52 increases.

The structural sheathing shown in FIGS. 4 and 5 may be covered first with an underlayment of paper or felt as required.

Insert 10 is molded from foam, typically 1 or 2 pound density expanded polystyrene. Other foams and other insulating materials capable of providing structural support as well as thermal insulation may equally well be employed without departing from the intent or spirit of the present invention. Whatever insulating material is used, it should be fire resistent or treated with a fire retardant.

Foam insert 10 can be treated with TIM-BOR, a borate containing product effective in resisting termite infestation, as well as other commercially available insecticides and termicides.

Whereas the interlocking raised construction panels depicted in FIGS. 1 through 5 are simulated shake roofing panels commonly formed of aluminum, foam inserts that are shaped to fit, free floating, within other types of raised roofing and siding panel, panels fabricated from other metals and from materials other than metal, as for example thermoplastic materials, panels which interlock in different manners, and panels exhibiting a variety of shapes, sizes and decorative motifs, including panels shaped to simulate ceramic tile, are considered to be within the parameters the present invention.

SUMMARY AND SCOPE

Accordingly, it will be readily appreciated that the free floating insulating insert of the present invention serves to enhance the structural integrity and durability of raised construction panels while at the same time providing the paneling with efficient thermal insulating characteristics. Unlike insulation that is layered within or adhered to the back of raised building panels, the foam inserts of the present invention are free floating and sized to allow a narrow vertical and horizontal air-gaps between the outside surfaces of the insulating insert and the inside surfaces of the raised portions of the construction panel. This construction ensures that the foam insert will not press outward against and deform the construction panels or roof or building surface. Occupants of buildings which utilize the insulated covering of the present invention will not experience annoying sounds during times of rapid temperature changes caused when prior art metal construction panels expand in an non-uniform manner in relation to the underlying insulation layer or backing.

Although the description above has been described and illustrated in connection with a number of preferred embodiments, these should not be construed as limiting the scope of the invention but as merely providing illustrations of some of the presently preferred embodiments of this invention, as those skilled in the art will readily understand. Modifications and variations are considered to be within the purview and scope of the present invention as defined in the appended claims and their legal equivalents.

The embodiments of the invention in which an exclusive property or privilege is claimed are defined as follows:

1. An insulated covering for solid building sheathing, comprising:

(a) a construction panel having a plurality of raised aspects;

(b) an insert made of insulation material having a density sufficient to support anticipated loads;

(c) wherein said insert is shaped to follow the contours of said construction panel and sized to leave a narrow continuous air-gap between the outside surface of said insert and the inside surface of said raised aspects of said construction panel; and (d) wherein said insert is allowed to float, freely, within the raised aspects of said panel when said panel is secured to said solid sheathing.

2. An insulated covering for building sheathing according to claim 1 wherein said narrow continuous air-gap ranges between from 1 to 6 millimeters in width, vertically, and 6 to 20 millimeters in width, horizontally.

3. An insulated covering for building sheathing according to claim 1 wherein said construction panels interlock with one another.

4. An insulated covering for building sheathing according to claim 1 wherein said insulation material is foam.

5. An insulated covering for building sheathing according to claim 1 wherein said insulation material is 1 to 2 pound density expanded polystyrene.

6. An insulated covering for building sheathing according to claim 1 wherein said insulation material is treated with a fire retardant.

7. An insulated covering for building sheathing according to claim 1 wherein said insulation material is treated with an insecticide.

8. An insulated covering for building sheathing according to claim 1 wherein said insulation material is treated with a borate containing compound that resists termites.

9. An insulated covering for building sheathing according to claim 1 wherein said construction panel is formed of aluminum and pressed to simulate shake roofing material, and wherein said insert is shaped to follow the contours of said simulated shake panel.

10. An insulated covering for building sheathing according to claim 1 wherein said construction panel is formed of thermoplastic and molded to simulate ceramic tile and wherein said insert is shaped to follow the contours of said simulated ceramic tile panel.

11. An insulated covering for building sheathing according to claim 1 wherein said construction panel is molded to demonstrate alternating high and low profile surfaces separated by panel gutters, and wherein said insert is shaped with corresponding high and low profile surfaces separated by gutters.

12. An insulating insert for use with raised construction panels that are secured to solid building sheathing comprising an insert formed of insulating material having a density sufficient to support anticipated loads, shaped to follow the contours of said construction panel, and sized to leave a narrow continuous air-gap between the outside surface of said insert and the inside surface of the raised aspects of said construction panel, said insert being allowed to float, freely, within said raised aspects of said panel when said panel is secured to said solid sheathing.

* * * * *